US006637721B1

(12) United States Patent
Zonca

(10) Patent No.: US 6,637,721 B1
(45) Date of Patent: Oct. 28, 2003

(54) ICE TRAY

(76) Inventor: Kim Zonca, 190 Freeman St., Brooklyn, NY (US) 11222

( * ) Notice: Subject to any disclaimer, the term of this patent is extended or adjusted under 35 U.S.C. 154(b) by 72 days.

(21) Appl. No.: 09/658,714

(22) Filed: Sep. 11, 2000

(51) Int. Cl.[7] ..... B29C 33/42
(52) U.S. Cl. ..... 249/52; 249/119; 249/126
(58) Field of Search ..... 249/52, 117, 119, 249/126; D15/90

(56) References Cited

U.S. PATENT DOCUMENTS

| | | | | | |
|---|---|---|---|---|---|
| 1,407,614 | A | * | 2/1922 | Wicks | 220/555 |
| 1,907,503 | A | * | 5/1933 | Chilton | 249/120 |
| 2,434,803 | A | * | 1/1948 | Johnson et al. | 249/126 |
| 3,021,695 | A | * | 2/1962 | Voigtmann | 249/127 |
| 3,930,376 | A | * | 1/1976 | Schwartz | 249/127 |
| 4,417,716 | A | | 11/1983 | Penna et al. | 249/121 |
| 5,364,063 | A | | 11/1994 | Nishimura et al. | 249/52 |
| 5,809,797 | A | | 9/1998 | Ryu | 62/340 |
| 5,830,379 | A | | 11/1998 | Tunzi | 249/126 |
| 5,971,352 | A | * | 10/1999 | Kirks | 249/117 |
| 6,345,802 | B2 | * | 2/2002 | Moore | 249/117 |

OTHER PUBLICATIONS

Loewy, "Gotham: Who Wants To Be a Millionaire?," New York Magazine, Nov. 22, 1999, p. 15.

* cited by examiner

*Primary Examiner*—James P. Mackey
*Assistant Examiner*—Donald Heckenberg
(74) *Attorney, Agent, or Firm*—Pennie and Edmonds LLP

(57) ABSTRACT

The present invention provides an improved ice tray that forms narrow ice pieces that easily fit through the opening of portable beverage containers such as standard cans, bottles, and cartons, thereby saving the costs and energy associated with refrigeration. The ice tray has one or more narrow cavities for receiving water. A protrusion in the cavity produces a notch in the ice so that the ice may be broken into smaller pieces and conveniently dropped into the beverage containers. Multiple ice trays may be stacked on top of each other.

2 Claims, 6 Drawing Sheets

ICE TRAY

TECHNICAL FIELD

The present invention relates to an apparatus for making ice, and, more particularly, to an improved ice tray to be used for making ice pieces which are configured so as to easily fit into the opening of an individual beverage container.

BACKGROUND OF THE INVENTION

Previous ice trays have been devised and utilized for the purpose of making ice pieces which easily fit into drinking cups or glasses. These traditional ice pieces are too large to fit into the opening of individual beverage containers such as cans, bottles, and cartons as such containers have a narrower mouth than typical drinking cups. However, consumers are more frequently drinking out of individually packaged beverage containers and demand that their beverages are chilled.

It may be difficult to refrigerate such containers. These containers are oftentimes not stored in a refrigerator due to energy concerns. Refrigeration requires a great deal of energy and therefore can be costly. To save costs and energy, stores may not keep beverage containers in a refrigerator.

Also, these individually packaged beverages may not be chilled in a refrigerator due to a shortage of space in commercial or domestic refrigerators, or the lack of space for a sufficient number of refrigerators. Since consumer demand is for beverages that are chilled, the inability to chill beverages may result in a loss of profits and business.

Accordingly, there is a need in the art for a more cost-effective, energy-efficient, and space saving means for chilling beverages.

SUMMARY OF THE INVENTION

Accordingly, the invention addresses this need by providing an ice tray to be used to make ice pieces that easily fit into the mouth of a beverage container, such as a bottle, can, or carton commonly used for soda, juice, or other beverage.

The present invention provides an ice tray comprising a top surface and at least one cavity in the top surface for receiving water to be frozen and formed into an ice piece wherein the cavity has at least one dimension, such as the diameter, less than about 0.75 inches so as to allow the ice piece to be inserted into the opening of a beverage container. Alternatively, the defined cavity has at least two transverse dimensions, such as the width and the depth, which are less than 0.75 inches.

The present invention also provides an ice tray comprising an uneven top surface defining at least one cavity in the top surface having at least two dimensions less than about 0.75 inches; a protrusion extending upward from the bottom of the cavity for forming a notch in the ice piece where the ice piece can easily be broken; and a plurality of support feet which extend from the bottom surface of the ice tray which facilitates stacking multiple trays.

Thus, the present invention provides an ice tray that can be used to make ice pieces having dimensions which fit into the mouth of a beverage container thereby also providing a means for saving energy by decreasing the need for refrigeration space for beverages.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE PREFERRED EMBODIMENTS

The ice tray of the present invention is discussed herein with reference to a preferred embodiment.

Figure 1:
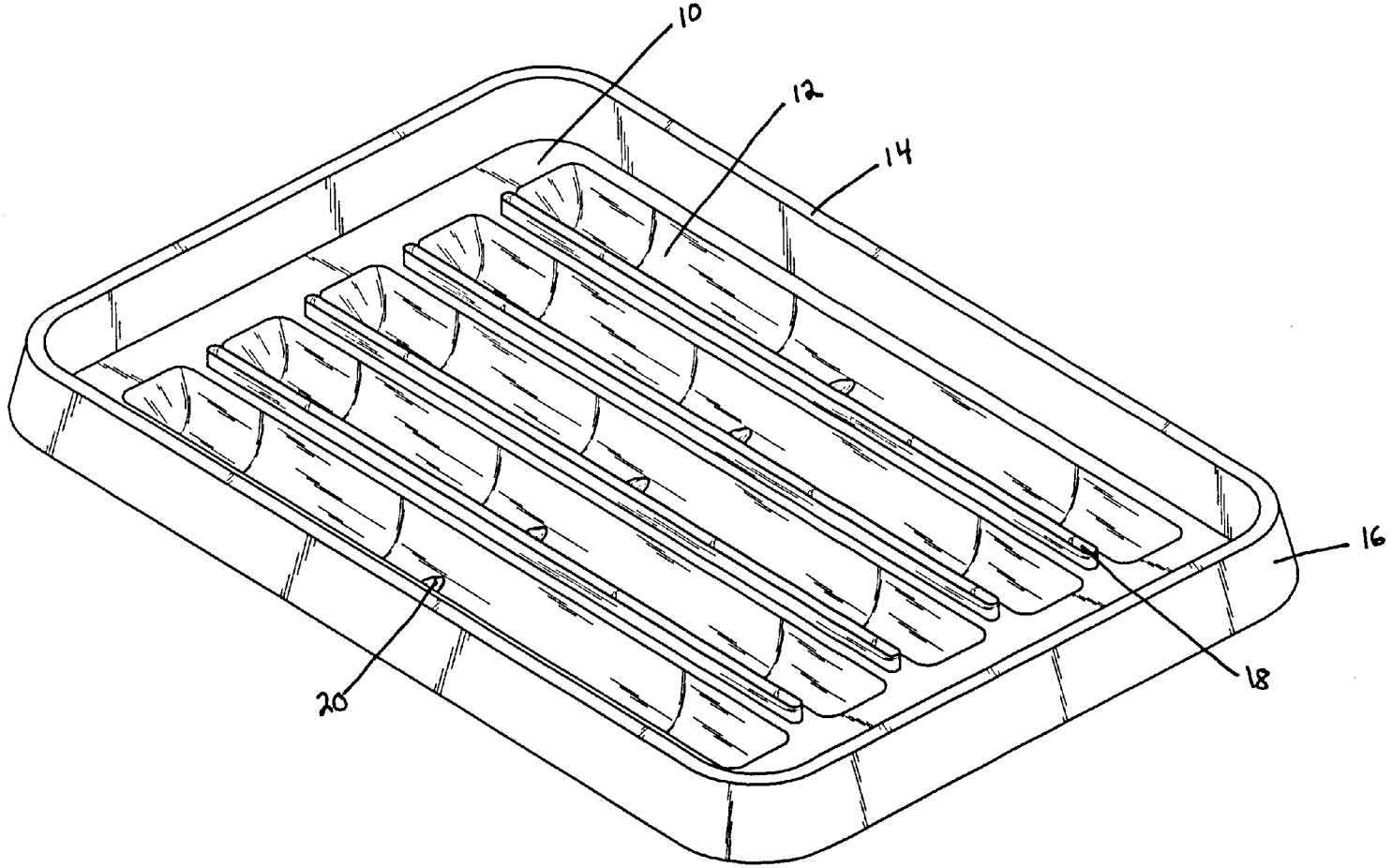
FIG. 1 is a perspective view of an ice tray of the present invention.
Figure 2:
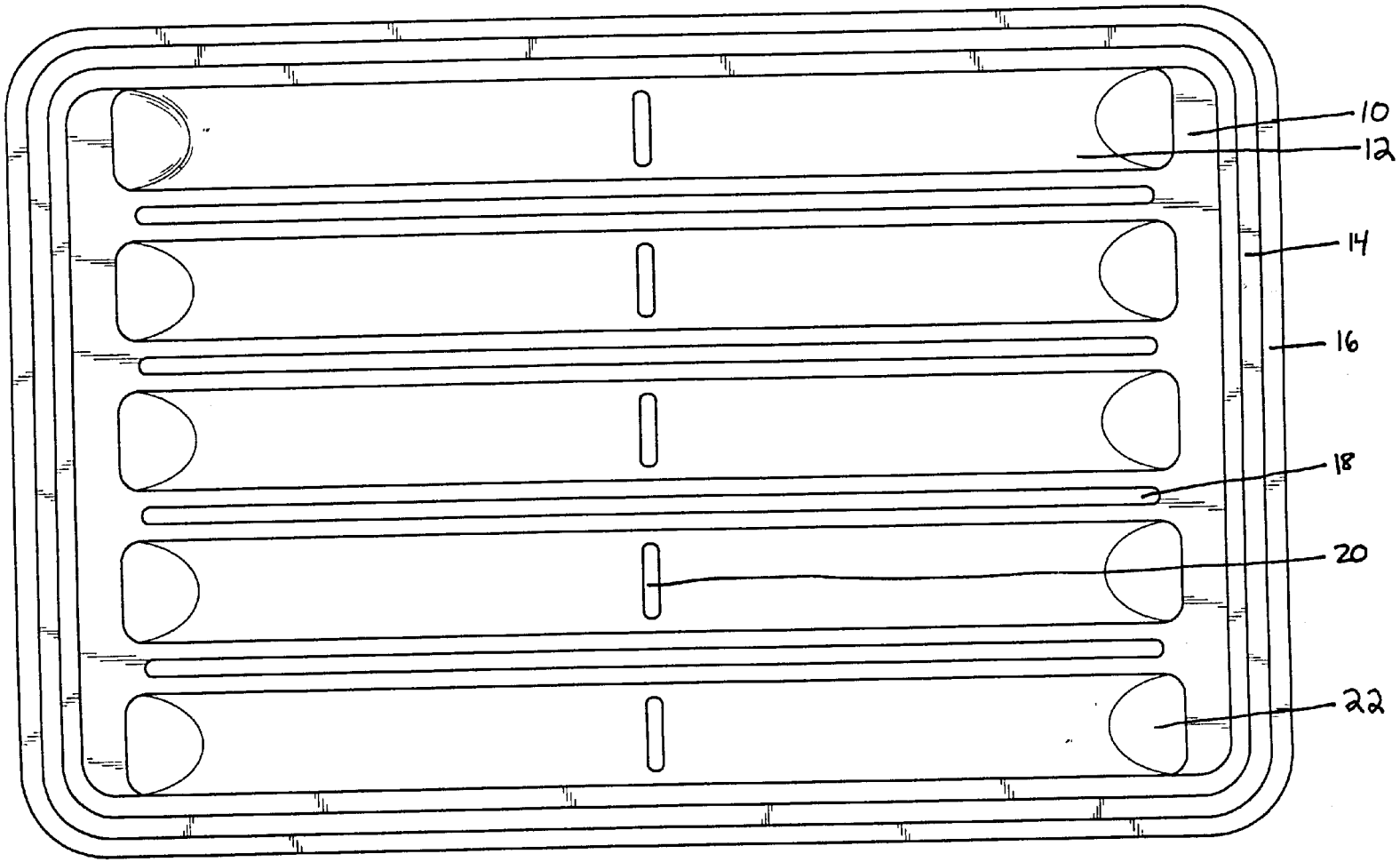
FIG. 2 is a top view of an ice tray.
Figure 3:
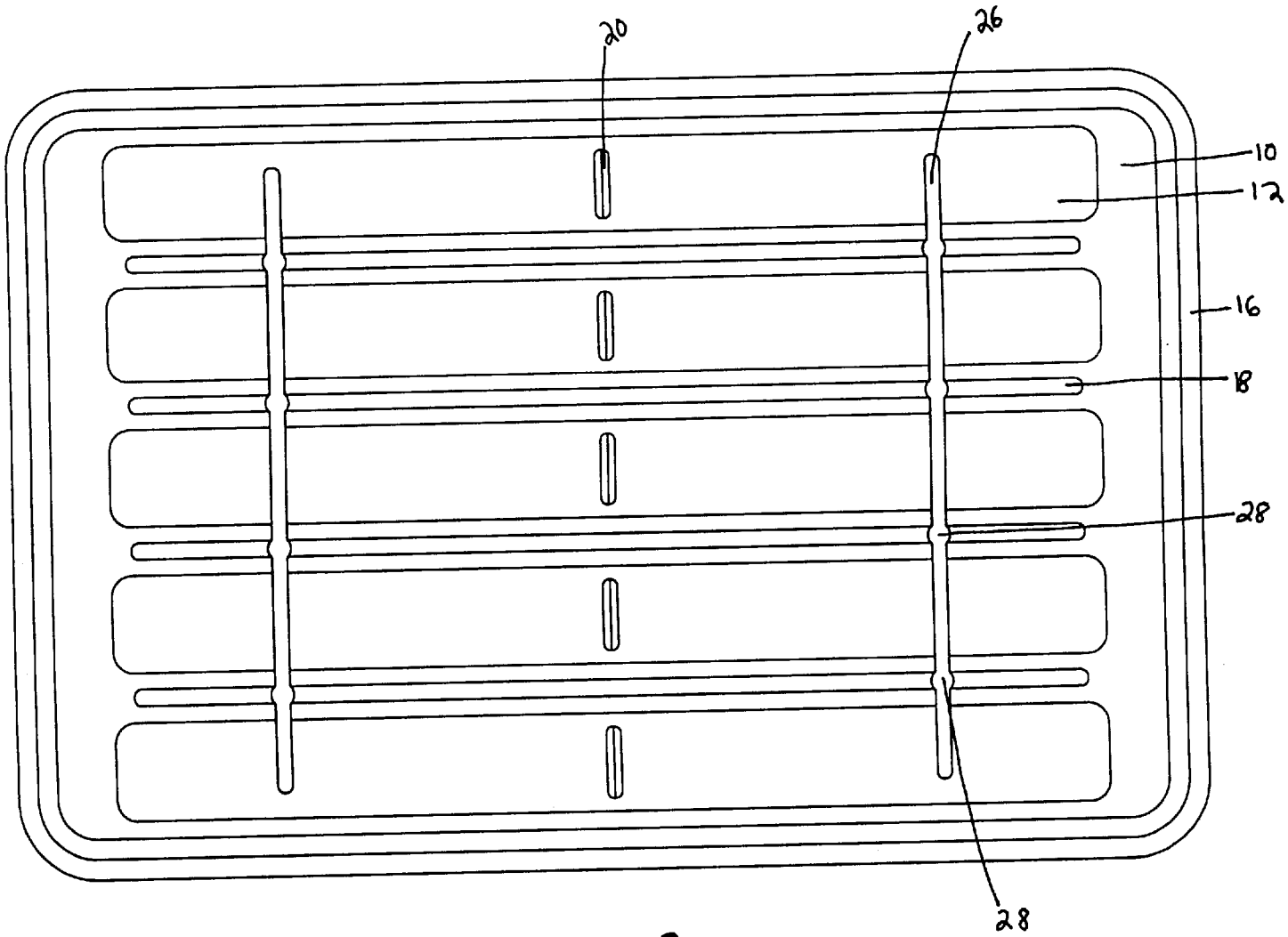
FIG. 3 is a bottom view of an ice tray.

FIG. 1 is a perspective view of an ice tray of the present invention. FIG. 2 is top view of the ice tray, and FIG. 3 is a bottom view of the ice tray. The ice tray generally includes a single body of material comprising an uneven top surface 10 that may be configured and dimensioned to define at least one cavity 12 extending beneath the top surface 10.

Figure 4:
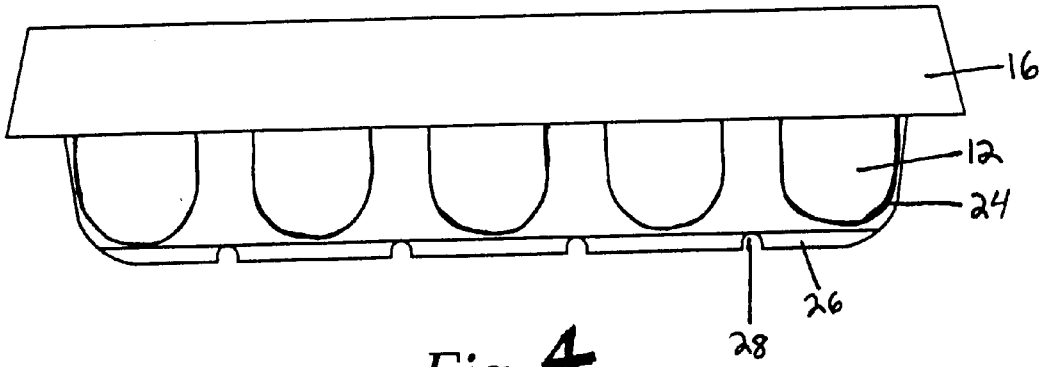
FIG. 4 is an end view of an ice tray.
Figure 5:
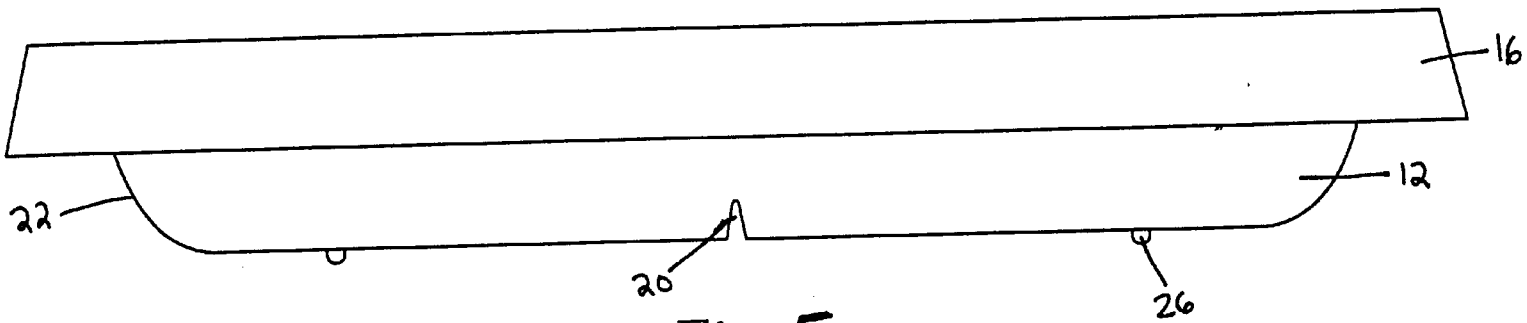
FIG. 5 is a side view of an ice tray.

The top surface 10 may have an elevated rim 14 to prevent spillage of water when filling the ice tray. FIG. 4 shows an end view of the ice tray, and FIG. 5 shows a side view of the ice tray. As shown in FIGS. 4 and 5, the top surface 10 may also have downwardly angled edges 16 along the outside edge of the rim 14 to act as a lip for ease of lifting.

The top surface 10 may have a plurality of raised ridges 18 between and parallel to the cavities 12 to facilitate stacking of two or more ice trays.

Figure 6:
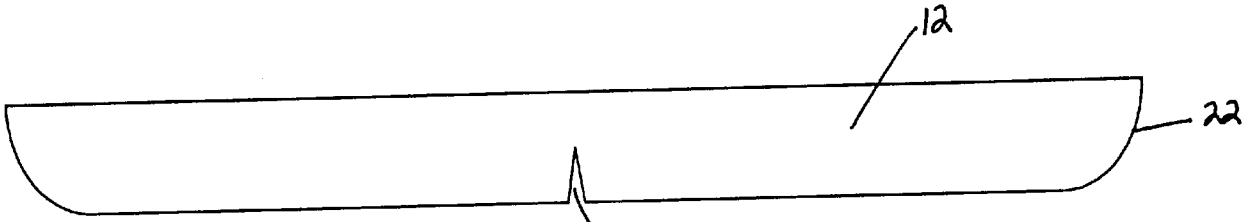
FIG. 6 is a side view of a cavity of an ice tray.
Figure 7:
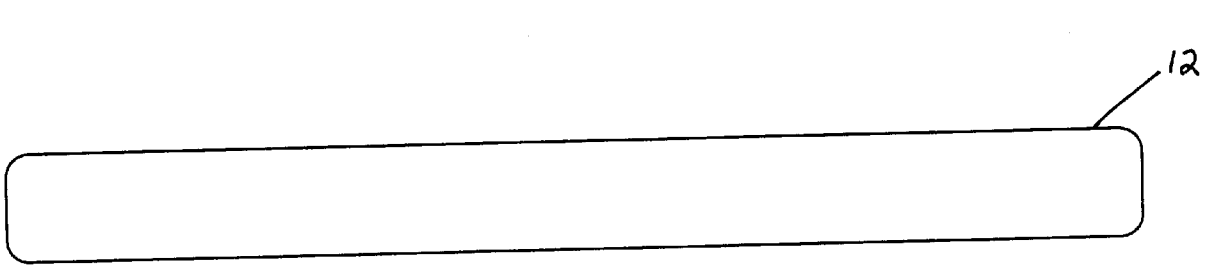
FIG. 7 is a top view of a cavity of an ice tray filled with ice.
Figure 8:
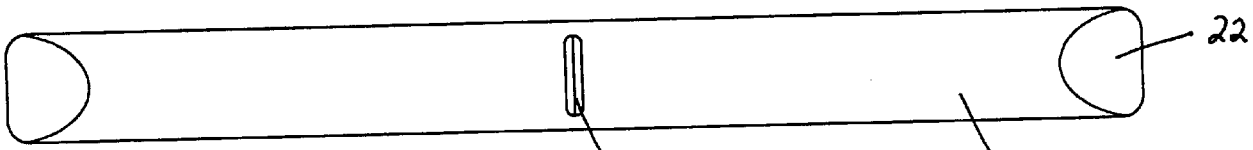
FIG. 8 is a bottom view of a cavity of an ice tray.

FIG. 6 is a side view of a cavity 12 of an ice tray; FIG. 7 is a top view of a cavity 12 of an ice tray filled with ice; and FIG. 8 is a bottom view of a cavity 12 of an ice tray. The cavities 12 receive water or other liquid to be frozen and formed into one or more ice pieces. Preferably, there are 1 to 50 or more cavities 12, and most preferably five cavities 12. The cavities 12 may be parallel to each other, or in any other desired configuration. The cavities generally are dimensioned to define an ice piece that can be inserted into the opening and through the mouth of a beverage container. The cavities 12 may have any dimensions, but preferably, at least two transverse dimensions are less than 1.0 inch so as to allow the ice piece to be inserted into the opening and through the mouth of a beverage container. Preferably, the transverse dimensions are the width, depth, or both, and are more preferably less than 0.75 inches and most preferably 0.6 inches. Preferably, the length of the cavity is about 1 inch to about 8 inches, and preferably about 6 inches.

The cavity 12 may contain a protrusion 20 extending from the bottom of the cavity 12 into the cavity 12 itself as shown in FIG. 6. The protrusion 20 may generally be perpendicular to the longitudinal axis of the cavity 12, and the height of such protrusion 20 will generally be less than the depth of the cavity 12. There may be one or more protrusions 20 in the cavity 12. Preferably, there is one protrusion 20 generally in the middle of the cavity 12. The presence of the protrusion 20 will cause a notch to be formed in the ice piece. The notch is advantageously designed to enable breaking the ice piece into smaller pieces.

The cavity 12 may have arcuate-shaped ends 22 that are tapered inward from the top surface 10 to allow for easy removal of the ice pieces. The walls 24 of the cavity 12 may be rounded to form a semi or half cylindroid or half-cylindrical shape.

Figure 9:
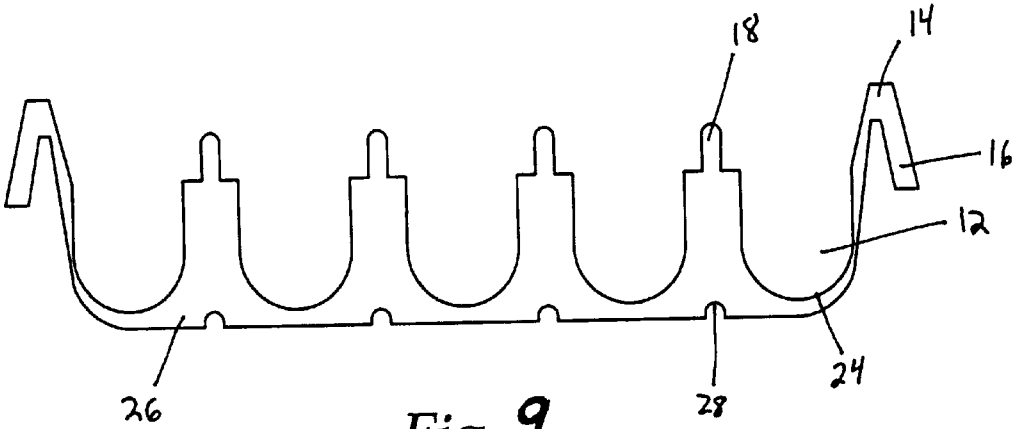
FIG. 9 is a cross-sectional end view along a support foot of an ice tray.
Figure 10:
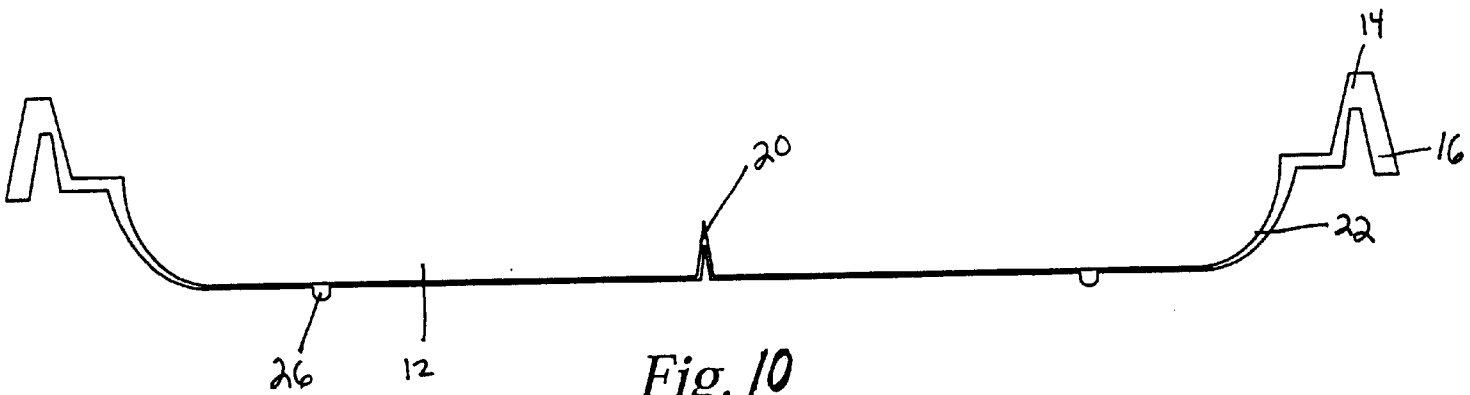
FIG. 10 is a cross-sectional side view along a cavity of an ice tray.

FIGS. 3 and 4 show two narrow support feet 26 extending outward from the bottom of the ice tray and perpendicular to the length of the cavities 12. The support feet 26 allow for level resting on a flat surface. FIG. 9 is a cross-sectional end view along a support foot 26 of an ice tray. The support feet 26 have a plurality of shift-limiting notches 28 which are generally aligned with the ridges 18 on the top surface 10. The shift-limiting notches 28 may be slight hemispherical indentations between each cavity 12 which are aligned with the ridges 18 on the top surface 10 of the ice tray. The shift-limiting notches 28 conveniently interlock with the ridge 18 on the top surface 10 when multiple ice trays are stacked on top of each other. In particular, the shift-limiting notches 28 rest on top of the ridges 18 of another tray. FIG. 10 is a cross-sectional side view along a cavity 12 of an ice tray, and shows a cross-section of two support feet 26. The ice tray of the present invention may have more than two support feet 26 in any suitable configuration that allows the ice tray to be balanced on a surface and stacked on top of another ice tray.

The ice tray may be manufactured out of any non-toxic plastic, rubber, aluminum, or other suitable material. Preferably, the ice tray is made from high-density polyethylene. The material may be formed into the shape of the ice tray by the process of injection molding, blow molding, rotational molding, vacuum forming, stamping, or any other process known in the art. The preferred process is injection molding.

The ice tray functions by pouring water or any other desired liquid into the cavities 12 of the tray, and placing the tray in a freezer or otherwise subjecting the tray containing the liquid to a temperature at or below the freezing point of the liquid. Once the liquid in the tray freezes, the ice may be released from the tray by placing one hand on opposite corners or sides of the tray and gently twisting the tray. The tray may also be inverted for ease in removing the ice pieces. The ice may also be removed by placing a fingernail or other object under one end of the ice piece and prying the ice loose from the tray. The ice may then be broken where the ice has a notch due to the protrusion 20 in the cavity 12. The user may then drop the pieces of ice into the mouth of a beverage container to chill a beverage. As the ice pieces melt, the user may add more ice pieces to keep the beverage chilled.

By utilizing the claimed invention, retailers of everyday refreshment drinks may maintain a very limited quantity of high priced cold drinks and a higher quantity of low priced room-temperature drinks which may be quickly chilled by utilizing the ice tray of the present invention to chill the drink on demand. This type of "just in time" inventorying of cold drinks will result in substantial energy savings for the retailer which may be passed on to the consumer. Additionally, many retailers cannot afford the expense of sizable refrigerators for cold drinks. The present invention enables those retailers to offer chilled drinks at a fraction of the cost.

What is claimed is:

1. An ice tray comprising:

an uneven top surface defining at least one cavity having at least two dimensions less than about 0.75 inches;

a protrusion within the cavity for forming a notch in an ice piece, wherein the protrusion has a height less than the depth of the cavity and is generally perpendicular to the longitudinal axis of the cavity;

a plurality of ridges on the top surface for stacking multiple ice trays, wherein the ridges are parallel to the cavity; and a plurality of support feet extending from the bottom of the ice tray perpendicular to the length of the cavity, wherein the support feet have a plurality of shift-limiting notches which interlock with the ridges on the top surface of another ice tray when multiple ice trays are stacked.

2. An ice tray comprising:

an uneven top surface defining at least one cavity having at least two dimensions less than about 0.75 inches, wherein the top surface has an elevated rim;

a protrusion within the cavity for forming a notch in an ice piece, wherein the protrusion has a height less than the depth of the cavity and is generally perpendicular to the longitudinal axis of the cavity;

a plurality of support feet extending from the bottom of the ice tray; and a plurality of ridges on the top surface for stacking multiple ice trays, wherein the ridges are parallel to the cavity, and the support feet have a plurality of shift-limiting notches which interlock with the ridges on the top surface of another ice tray when multiple ice trays are stacked.

* * * * *